US005876140A

United States Patent [19]

Kuramoto et al.

[11] Patent Number: 5,876,140

[45] Date of Patent: Mar. 2, 1999

[54] CAP DEVICE

[75] Inventors: Michiaki Kuramoto, Shinagawa-Ku; Minoru Machida; Norio Moriyama, both of Isesaki, all of Japan

[73] Assignee: Kabushiki Kaisha Pilot, Tokyo-To, Japan

[21] Appl. No.: 793,260

[22] PCT Filed: Jun. 20, 1996

[86] PCT No.: PCT/JP96/01711

§ 371 Date: Feb. 21, 1997

§ 102(e) Date: Feb. 21, 1997

[87] PCT Pub. No.: WO97/00780

PCT Pub. Date: Jan. 9, 1997

[30] Foreign Application Priority Data

Jun. 22, 1995 [JP] Japan ..... 7-179522

[51] Int. Cl.[6] ..... B43K 23/08; B43K 23/12

[52] U.S. Cl. ..... 401/202; 215/295; 401/213; 401/243; 401/247

[58] Field of Search ..... 220/281; 215/303, 215/305, 295; 401/202, 213, 243, 247, 244, 246

[56] References Cited

U.S. PATENT DOCUMENTS

| | | | |
|---|---|---|---|
| 2,476,155 | 7/1949 | McKelvy | 215/295 |
| 3,632,006 | 1/1972 | Gilson | 215/303 X |
| 3,995,765 | 12/1976 | Burke | 220/281 |
| 4,982,882 | 1/1991 | Gueret | 220/281 X |

FOREIGN PATENT DOCUMENTS

| | | | |
|---|---|---|---|
| 2600976 | 1/1988 | France | 215/295 |
| 2327334 | 12/1973 | Germany | 215/295 |
| 2-23569 | 6/1990 | Japan . | |
| 4-26343 | 6/1992 | Japan . | |
| 7-6102 | 2/1995 | Japan . | |
| 559673 | 3/1975 | Switzerland | 215/321 |

*Primary Examiner*—Steven A. Bratlie

*Attorney, Agent, or Firm*—Wenderoth, Lind & Ponack, L.L.P.

[57] ABSTRACT

A cap is fitted onto an engagement portion of a main body such as that of a writing implement, paint applicator, make-up applicator, or container. An inner wall of the cap is provided with a flexible operating member having a free end capable of bending inward. An oblique guide surface is formed on at least one of the main body and the cap such that the cap can be separated from the main body by pressing the operating member inward.

8 Claims, 5 Drawing Sheets

CAP DEVICE

BACKGROUND OF THE INVENTION

1. Field of the Invention

The present invention relates to a cap device and, in particular, to a cap device which includes a cap that can be removed easily by a one-handed operation from an engagement portion on a main body such as that of a writing implement, paint applicator, make-up applicator, or container.

2. Description of the Related Art

A cap fitted onto a main body, such as that of a writing implement, paint applicator, make-up applicator, or container, can be separated therefrom by pulling it away from an engagement portion. With an article having a main body containing a liquid which would cause problems if it were to dry out, such as an applicator (correction pen) containing correcting ink, it often happens that the solvent within the correcting ink evaporates from the applicator tip so that the correcting ink accommodated within the main body solidifies, making it unusable. To prevent this, means, such as an inner cap, is provided within the cap to maintain a hermetic seal around the applicator tip. Also, the cap engages with the engagement portion of the main body with a comparatively strong engagement force. With this type of cap, it is necessary to use both hands to pull the cap from the engagement portion of the main body, and thus it is difficult to separate the cap from the main body by a one-handed operation.

"Device for Causing Cap To Spring Off Pen", disclosed in Japanese Utility Model Application Laid-Open No. 48-18239, and "Capped Container", disclosed in Japanese Patent Application Laid-Open No. 61-259962, are known means of pulling a cap from an engagement portion of a main body by a one-handed operation. However, these prior-art techniques do not relate to the present application in which the cap itself is of a configuration whereby the cap can be separated easily from the engagement portion of the main body by a one-handed operation. In the former prior-art technique, a pressure member is inserted between the cap and the pen shaft. To operate this pressure member, it is necessary to provide a handle portion of a fairly large surface area in such a manner that it is exposed to the exterior, which makes it impossible to obtain a product with an attractive design.

In addition, if the handle portion is made larger so as to make it easy to operate, a problem arises in that the handle portion is obstructive when the pen shaft is held during writing or the application of liquid.

In the latter prior-art technique, a sliding member that touches an aperture end surface of the inner cap is provided on the main body side, with the arrangement being such that the sliding member is pushed in a protruding direction by a spring. However, this prior-art technique necessitates modification of the engagement portion of the container itself, creating a problem in that it makes it impossible to utilize the mechanism that has long been known in the art for engagement between a cap and a main body such as that of a writing implement, paint applicator, make-up applicator, or container.

It is therefore an object of the present invention to solve the above described problems which are inherent in the prior-art technology and provide a cap device in which the implementation of a simple process on the cap alone makes it possible to pull the cap away from an engagement portion on a main body such as that of a writing implement, paint applicator, make-up applicator, or container by a one-handed operation.

SUMMARY OF THE INVENTION

The present invention relates to a cap device in which a cap is fitted onto an engagement portion of a main body and the cap can be separated from the main body by a pulling action. The cap device is characterized in that an inner wall of the cap device is provided with a flexible operating member having a free end capable of bending inward and also an oblique guide surface is formed on at least one of the main body and the cap. The cap is removed by utilizing a reaction force applied to the operating member via the oblique guide surface.

The operating member of this invention can be configured by cutting an inner wall surface into a shape such as a U-shape, in such a manner that a free end thereof can move inward and contact an oblique guide surface on the main body. The operating member can also be formed as a piece that is separate from the cap, in such a manner that the operating member can fit into the cap.

The configuration could be such that an oblique guide surface is formed on an inner side of the free end of the operating member, and this oblique guide surface touches a step portion formed in the engagement portion of the main body.

To separate the cap smoothly from the engagement portion of the main body, without requiring excessive force, it is important that the cap can be pulled off directly along the axial line of the main body. It would therefore be desirable if the cap could be pulled away from the main body by pushing inwardly, with the same force, operating members provided at two opposite positions on an inner wall surface of the cap.

When these two operating members are pushed inwardly, the operating members move along axial lines thereof until they contact an oblique guide surface or step portion formed in the main body side. Further pressure subjects the operating members to a reaction force from the oblique guide surface or the step portion, and this reaction force acts as a component of the force pulling the cap from the engagement portion of the main body. This moves the cap in the direction in which it separates from the engagement portion of the main body. Also, since the engagement between the cap and the engagement portion of the main body is released, the cap can be separated from the engagement portion of the main body by a simple one-handed operation.

Since the cap of this invention is configured as described above, the cap can be separated easily from a main body, such as that of a writing implement, paint applicator, make-up applicator, or container, by an operation performed with a single hand, by applying pressure to the operating members.

The cap can be separated from the main body, such as that of a writing implement, paint applicator, make-up applicator, or container, by the application of pressure to the operating members. Therefore, it is not difficult to pull the cap off when sweat has made the hands slippery and has reduced the gripping power thereof, as it is when pulling off a prior-art cap. Thus, the cap can be separated easily from a main body, such as that of a writing implement, paint applicator, make-up applicator, or container, even by someone with little or no strength. This invention also has the advantage of utilizing a configuration that engages the cap firmly with the engagement portion of the main body.

DETAILED DESCRIPTION ON THE INVENTION

Embodiments will be described below with reference to the accompanying drawings, in order to illustrate the present invention in more detail.

The embodiments described below are examples of the application of the present invention to the cap of an applicator that contains correction ink and is known as a correction pen, but the present invention is not limited thereto and it can be applied equally well to a wide range of objects such as writing implements, paint applicators, make-up applicators, or containers.

Figure 1:
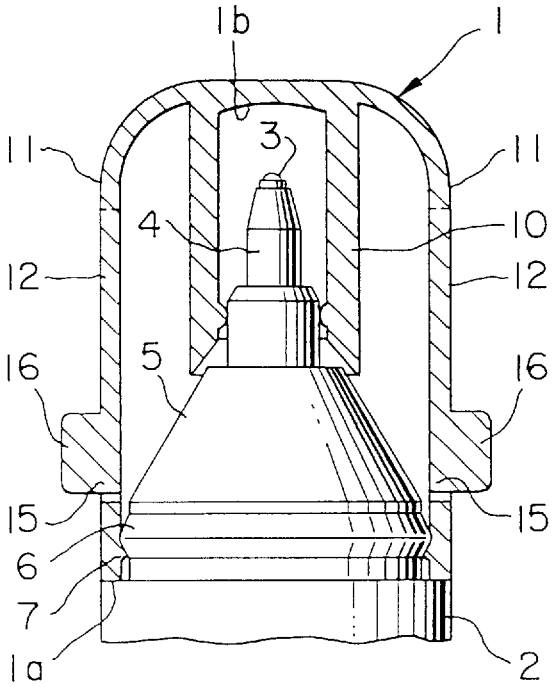
FIG. 1 is a vertical cross-sectional view of a first embodiment of this invention, showing a state in which a cap is engaged with an engagement portion of a main applicator body.
Figure 2:
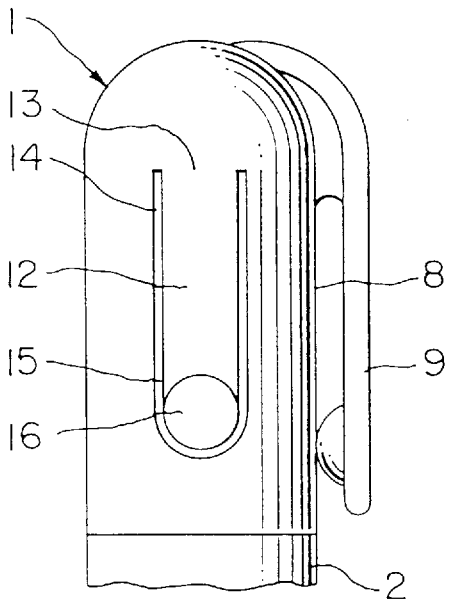
FIG. 2 is a side view of the cap of the first embodiment.

A cap in accordance with a first embodiment of this invention is shown in FIGS. 1 and 2.

Reference numeral 1 denotes a cap constructed in accordance with the first embodiment of the invention. Cap 1 is attached to an end portion of a main pen-type body 2 which has a lateral cross-sectional shape that is oval and which contains correction ink. The main body 2 has, in a tip 4 thereof, a ball 3 that is held or supported so that it can rotate. In addition, a tapering oblique guide surface 5 and an annular engagement portion 6 are formed adjacent to one another between tip 4 and the main body 2.

An annular protrusion 7 is formed on an inner wall surface of the cap 1 in the vicinity of an open end portion 1*a* of the cap 1. The annular protrusion 7 engages with a groove of the engagement portion 6 on the main body 2 side.

The lateral cross-sectional shape of the cap 1 is of an oval form that matches the lateral cross-sectional shape of the main body 2. A clip 9 is attached integrally to a side surface 8 on a wider side of the cap 1. An internal upper surface 1b of the cap 1 is provided with a concentric inner cap 10 that is configured in such a manner that hermetic sealing of the periphery of the tip 4 can be maintained when the cap 1 is engaged with the engagement portion 6 of the main body 2.

A pair of flexible operating members 12 are formed at two opposing positions on side surfaces 11 at narrower sides of the cap 1, respectively. Each of these operating members 12 is formed by cutting out an approximately U-shaped groove 14 so as to leave an upper base end portion 13. As is clear from FIG. 2, a free end 15 is thus formed at the opposite end from the base end portion 13, and a push-button 16 is formed integrally on an external surface of the free end 15. If a strong inward pressure is applied to the push-buttons 16 when the cap 1 of the thus-configured embodiment is to be removed, the operating members 12 flex inward about the fulcrums of the base end portions 13 and the inner ends of the free ends 15 are thrust against the oblique guide surface 5. If the operating members 12 are then pushed strongly inward, the cap 1 is subjected to a reaction force in the removal direction at the same time that the operating members 12 slide along the oblique guide surface 5, and eventually the cap 1 can be separated from the main body 2.

Figure 3:
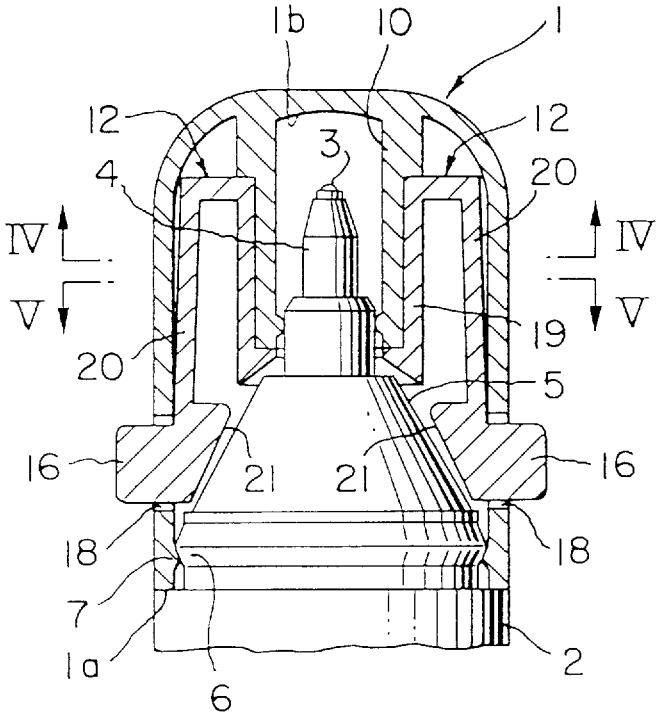
FIG. 3 is a vertical cross-sectional view of a second embodiment of this invention, showing a state in which a cap is engaged with an engagement portion of a main applicator body.
Figure 4:
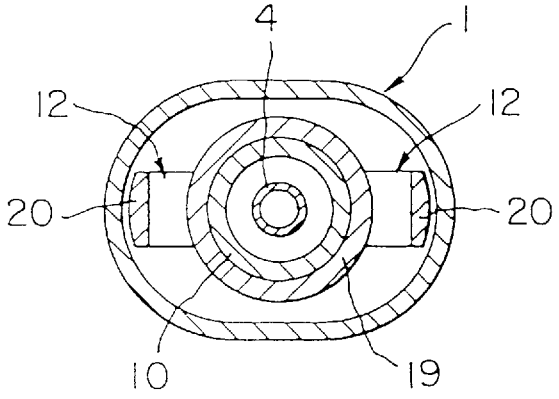
FIG. 4 is a lateral cross-sectional view taken along line IV—IV in FIG. 3.
Figure 5:
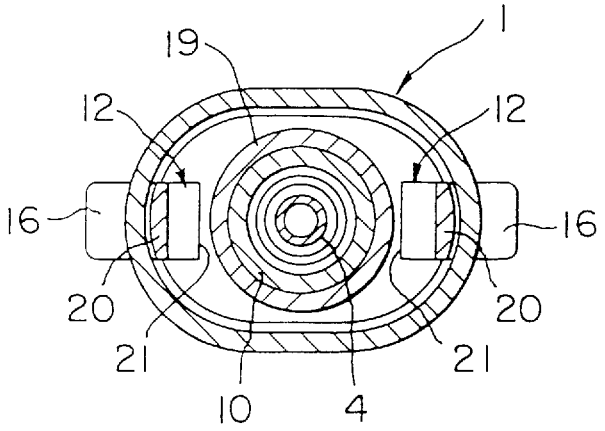
FIG. 5 is a lateral cross-sectional view taken along line V—V in FIG. 3.

A second embodiment of the present invention is illustrated in FIGS. 3 to 5. Components that are the same as those in FIG. 1 are denoted by the same reference numerals in FIGS. 3 to 5.

This embodiment provides an example in which the cap 1 and the operating members 12 are configured of separate pieces.

The annular protrusion 7 is formed on an inner side in the vicinity of the open end portion la of the cap 1. The annular protrusion 7 engages with a groove of the engagement portion 6 on the main body 2 side. Apertures 18 are formed at two opposing positions in the side surfaces at the narrower sides of the cap 1, immediately above the protrusion 7. The inner cap is provided on the internal upper surface 1b of the cap 1, in the same manner as in the first embodiment. A cylindrical support core 19 for the operating members 12 is fitted over inner cap 10, and release arms 20 that are angled in the radial direction and then in the axial direction extend elastically outward from an upper end of support core 19. Also, a push-button 16 is formed integrally on an outer surface at an end portion of each of the release arms 20. These push-buttons 16 protrude outward from within the apertures 18.

Figure 6:
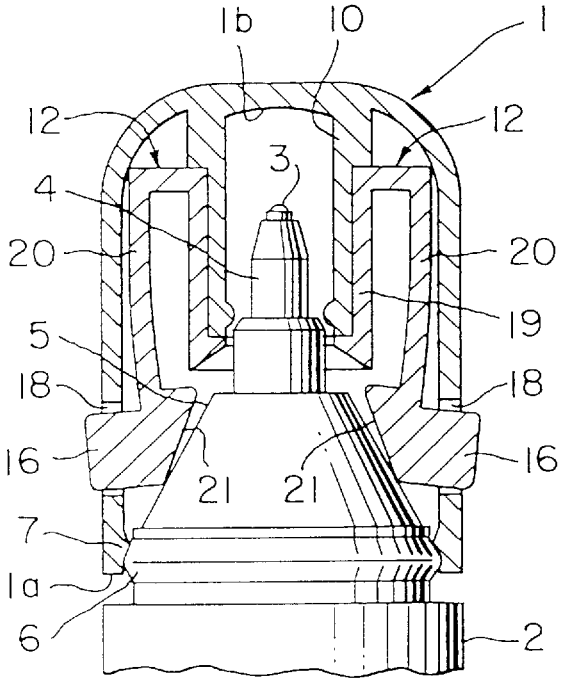
FIG. 6 is a vertical cross-sectional view, showing a state just before the cap, shown in FIG. 3, is removed from the engagement portion of the main applicator body.

An oblique guide surface 21 is formed on a surface of the inner side of each push-button 16. When the cap of the thus-configured embodiment is removed from the closed state as shown in FIG. 3, the push-buttons 16 are pushed strongly inward. This action thrusts the oblique guide surface 21, on the inside of each push-button 16, against the oblique guide surface 5 on the main body 2 side, as shown in FIG. 6. If the push-buttons 16 are pushed inward even more strongly, the cap 1 is subjected to a reaction force in the removal direction at the same time that the push-buttons 16 slide along the oblique guide surface 5, and eventually the cap 1 can be separated from the main body 2.

Figure 7:
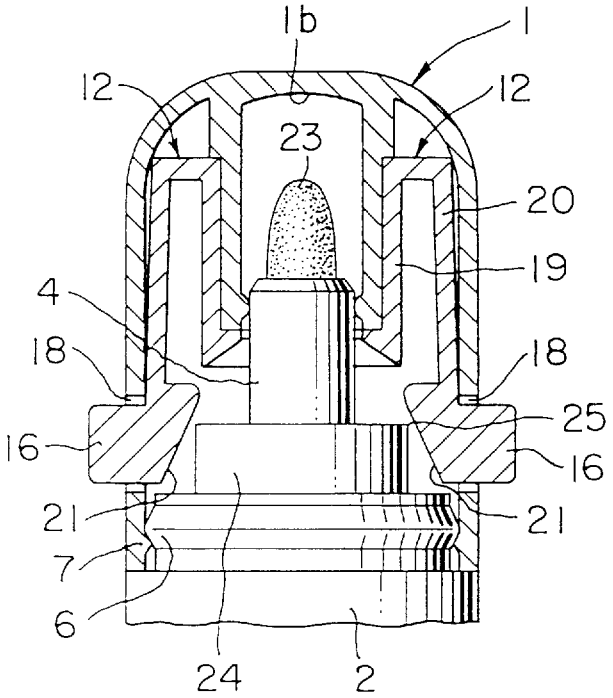
FIG. 7 is a vertical cross-sectional view of a third embodiment of this invention, showing a state in which a cap is engaged with an engagement portion of a main applicator body.
Figure 8:
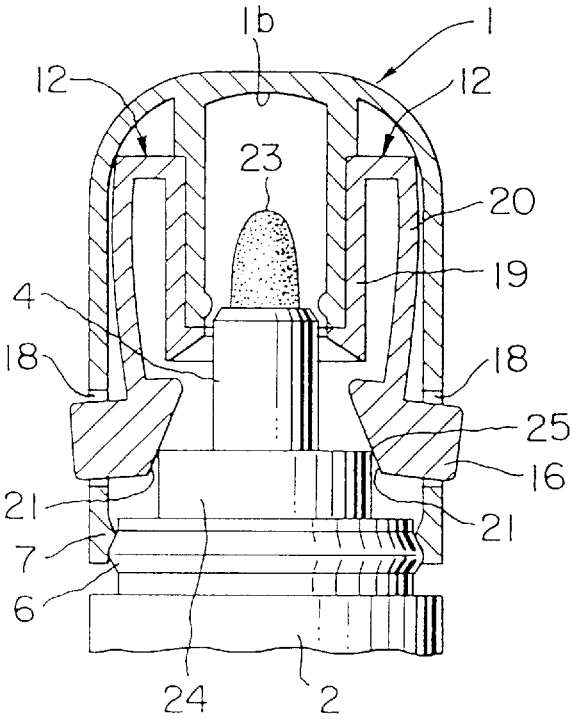
FIG. 8 is a vertical cross-sectional view, showing a state immediately before the cap, shown in FIG. 7, is removed from the engagement portion of the main applicator body.

The description now turns to a third embodiment, with reference to FIGS. 7 and 8. This embodiment is an example of the application of the present invention to a writing implement in which a fiber-tip pen 23 acts as an applicator tip. This embodiment differs from previous embodiments in that the oblique guide surface 5 provided on the side of the main body 2 is omitted and instead a short columnar guide shaft 24 is provided between the tip 4 and the engagement portion 6. An edge 25 of the guide shaft 24 is configured in such a manner that the oblique guide surfaces 21 of the operating members 12 act thereupon. When the cap of the thus-configured embodiment is to be removed from the closed state shown in FIG. 7, the push-buttons 16 are pushed strongly inward. This action brings the oblique guide surface 21 into contact with the guide shaft 24 on the main body 2 side, as shown in FIG. 8. If the push-buttons 16 are pushed even more strongly inward, the cap 1 is then subjected to a reaction force in the removal direction from the edge 25 of the guide shaft 24. A force acts on the cap 1 in the direction in which it is pulled off the main body 2, and eventually the cap 1 can be separated from the main body 2.

Figure 9:
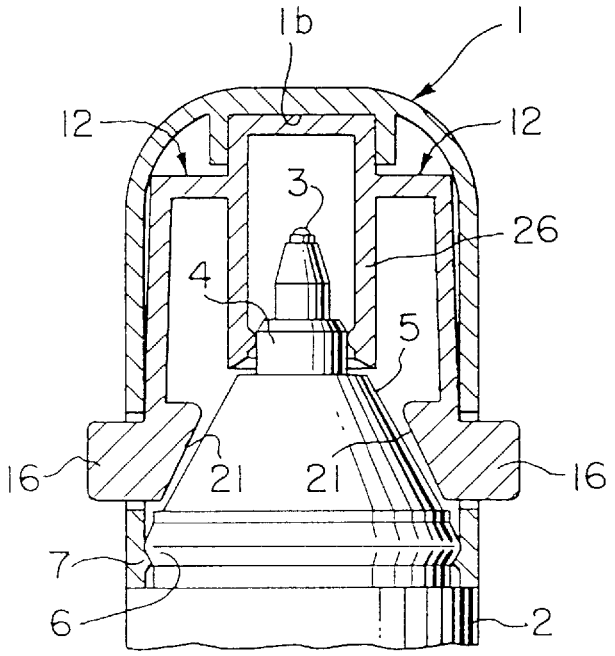
FIG. 9 is a vertical cross-sectional view of a fourth embodiment of this invention, showing a state in which a cap is engaged with an engagement portion of a main applicator body.

A fourth embodiment will now be described, with reference to FIG. 9.

This embodiment is substantially the same as the embodiment shown in FIG. 3, except that an inner cap 26 is provided on an inner side of the operating members 12. The rest of the configuration is the same as that of the embodiment of FIG. 3. This embodiment enables a reduction in the number of components and a reduction in the man-hours required for assembly. As a result, it has the advantage of enabling a reduction in the manufacturing costs.

The cap device of the present invention described above can be applied to a wide range of objects such as writing implements, paint applicators, make-up applicators, or containers.

We claim:

1. A liquid application device comprising:

a main body for containing a liquid therein, said main body including a liquid application tip, and an engagement portion provided around an end part of said main body, said end part having a converging oblique guide surface;

a cap having a closed top surface and an open end with an inner protrusion, said cap being removably fitted over said end part of the said main body with said inner protrusion disengageably fitted on said engagement portion, said cap top surface having a cylindrical inner cap depending therefrom so as to fit on said application tip for providing a hermetic seal between said application tip and said inner cap, and said cap having a pair of opposite apertures adjacent said open end of said cap; and an operating member secured to said inner cap, said operating member having a cylindrical support core securely fitted on said inner cap, a pair of opposite flexible release arms integrally extending in a cantilever fashion from said support core radially outward and along an inner surface of said cap toward said open end of said cap and terminating in free ends, and push buttons provided on said free ends and extending outward through said apertures, respectively, said push buttons having inner oblique guide surfaces extending substantially along said oblique guide surface of said end part of said main body, wherein said cap can be removed from said main body by pushing said push buttons inwardly so that said cap is removed due to a reaction force applied to said oblique guide surfaces of said operating member by said oblique guide surface of said main body.

2. The capped device as claimed in claim 1, wherein said converging oblique guide surface of said end part of said main body is a conical surface.

3. The capped device as claimed in claim 1, wherein said engagement portion of said main body is an annular ridge.

4. The capped device as claimed in 1, wherein said inner protrusion of said cap has an annular shape.

5. A liquid application device comprising:

a main body for containing a liquid therein, said main body including a liquid application tip, and an engagement portion provided around an end part of said main body, said end part having a guide shaft formed with an annular edge;

a cap having a closed top surface and an open end with an inner protrusion, said cap being removably fitted over said end part of the said main body with said inner protrusion disengageably fitted on said engagement portion, said cap top surface having a cylindrical inner cap depending therefrom so as to fit on said application tip for providing a hermetic seal between said application tip and said inner cap, and said cap having a pair of opposite apertures adjacent said open end of said cap; and an operating member secured to said inner cap, said operating member having a cylindrical support core securely fitted on said inner cap, a pair of opposite flexible release arms integrally extending in a cantilever fashion from said support core radially outward and along an inner surface of said cap toward said open end of said cap and terminating in free ends, and push buttons provided on said free ends and extending outward through said apertures, respectively, said push buttons having inner oblique guide surfaces converging toward said closed top surface of said cap and extending adjacent said edge of said end part of said main body, wherein said cap can be removed from said main body by pushing said push buttons inwardly so that said cap is removed due to a reaction force applied to said oblique guide surfaces of said operating member by said edge of said end part of said main body.

6. The capped device as claimed in claim 5, wherein said edge is annular.

7. The capped device as claimed in claim 5, wherein said engagement portion of said main body comprises an annular ridge.

8. The capped device as claimed in claim 5, wherein said inner protrusion of said cap has an annular shape.

* * * * *